US005292581A

United States Patent [19]

Viazmensky et al.

[11] Patent Number: 5,292,581

[45] Date of Patent: Mar. 8, 1994

[54] WET WIPE

[75] Inventors: Helen Viazmensky, South Windsor; Eugene R. Benjamin, Windsor Locks, both of Conn.

[73] Assignee: The Dexter Corporation, Windsor Locks, Conn.

[21] Appl. No.: 991,361

[22] Filed: Dec. 15, 1992

[51] Int. Cl.[5] ..... D04H 1/58

[52] U.S. Cl. ..... 428/288; 28/104; 428/289; 428/299; 428/297; 428/326; 428/913

[58] Field of Search ..... 428/288, 289, 299, 913, 428/326, 297; 28/104

[56] References Cited

U.S. PATENT DOCUMENTS

| | | | |
|---|---|---|---|
| 3,546,755 | 12/1970 | Lynch | 28/72.2 |
| 4,117,187 | 9/1978 | Adams et al. | 428/286 |
| 4,612,226 | 9/1986 | Kennette et al. | 428/134 |
| 4,755,421 | 7/1988 | Manning et al. | 428/224 |
| 5,009,747 | 4/1991 | Viazmensky et al. | 162/115 |
| 5,137,600 | 8/1992 | Barnes et al. | 162/115 |

FOREIGN PATENT DOCUMENTS

| | | | |
|---|---|---|---|
| 1057600 | 7/1979 | Canada | 117/199 |

*Primary Examiner*—James J. Bell
*Attorney, Agent, or Firm*—Chilton, Alix & Van Kirk

[57] ABSTRACT

Wet wipes having improved wet strength, wet thickness and wet toughness are provided by incorporating a wet strength agent in the fibrous web containing pulp fibers and at least five percent by weight man-made fibers and hydraulically entangling the web. No post-formation bonding treatment is employed and the fiber dispersion includes only about 1% by weight of the wet strength additive. The hydroentanglement coupled with the low amount of additive provides unexpected synergistic strength and absorbency characteristics. The wet wipe retains its strength characteristics despite packaging and prolonged storage in a wet condition.

19 Claims, No Drawings

WET WIPE

BACKGROUND OF THE INVENTION

The present invention relates generally to disposable wet wiping cloths and the like. More particularly, it is concerned with a new and improved nonwoven fibrous web material having sufficient wet strength to be used as a wet wipe, yet is capable of disintegration within a septic system after a brief period of time.

Wiping material of this type typically is prepackaged in a moist environment and is commonly used by consumers for cleansing or wiping parts of the body, particularly when wash water is not readily available or cannot be conveniently used. Travelers find such wipes especially convenient. These wipes have been used for applying or removing makeup or in cleansing other parts of the body, for example, as a substitute for conventional dry toilet paper.

As will be appreciated, these premoistened wipes often are disposed of through a sewer or septic system. Thus, while they must have sufficient wet strength to resist tearing and puncturing during use, they also must easily and readily disintegrate within the disposal systems and preferably, when disintegrated, be totally biodegradable. Disposable wipes of this type for personal hygienic use have been known for some time. Typically, they consist of nonwoven webs of fibrous material saturated with a cleansing solution and packaging in their wet condition for easy dispensing. The sheet material is stacked and wrapped in a liquid type package together with a wetting liquid that often includes bacteriacides and other biological control agents as well as perfumes, organism growth inhibitors, and the like.

Some wet wipes described heretofore have utilized a pH sensitive water soluble binder adhesive to achieve the requisite wet strength during packaging and use. The binders of such systems exhibit a resistance to weakening during storage, but are much more loosely bonded when the wipe has been immersed in a relatively large amount of substantially neutral water, allowing the wipe to readily break up in the turbulent water movement of the septic or sewer system. One such wet wipe is described in Adams et al U.S. Pat. No. 4,117,187 issued Sep. 26, 1978. Others have suggested the complete elimination of any binder system and rely instead on the hydroentanglement of the fibers within the wet wipe to achieve the requisite strength to process the web into a premoistened towelette for one time use. Such wet wipes readily disentangle when exposed to mild agitation so that they can be readily disposed of in the sewer and septic systems. A wipe of this type is described in U.S. Pat. No. 4,755,421, the disclosure of which is incorporated herein by reference. That patent describes a binder free hydroentangled web material consisting essentially of a blend of rayon fibers and papermaking pulp. While such materials exhibit acceptable absorption characteristics, the strength of such materials, particularly the wet strength thereof, is relatively poor as will be appreciated from the very rapid disintegration or breakup times exhibited by such materials.

Unfortunately, the addition of wet strength agents to nonwoven fibrous web materials to improve the wet properties of those materials significantly and deleteriously reduces the absorption characteristics of the fibrous web materials.

SUMMARY OF THE INVENTION

The present invention overcomes these previous problems in the art and yet achieves excellent wet strength, bulk or thickness, uniform liquid release, and pleasant cloth-like, tactile properties. In addition, the present invention can provide for a wipe material of the type described that qualifies as a totally biodegradable product and maintains an excellent absorption capacity coupled with substantially improved wet strength characteristics.

The nonwoven fibrous web material of the invention exhibits improved wet strength, wet thickness and wet toughness, indicative of substantially improved serviceability and resistance to breaking and tearing during converting operations and handling of the material on automated equipment.

The disposable nonwoven material of the present invention not only retains the desirable absorption capacity that permits it to absorb and hold a weight of water equal to about five or six times or more the dry weight of the nonwoven material, but also provides sufficient strength to prevent rupturing thereof during use and premature disintegration thereof coupled with an ability to disintegrate within the septic or sewer system in a relatively short period of time and, depending on the composition, totally biodegrade after two or three weeks.

Other features and advantages of the present invention will be in part obvious and in part pointed out more in detail hereinafter.

These results are achieved by providing a fibrous sheet material of pulp fibers, having at least 5% by weight of man-made fibers, wherein the fibers are initially dispersed within an aqueous dispersing medium containing a wet strength agent. After sheet formation, the web is hydraulically entangled to provide a synergistic effect with the wet strength agent such that the web material exhibits no significant reduction in absorption capacity while incorporating substantially improved wet strength characteristics.

A better understanding of these advantages, features, properties and relationships of the invention will be obtained from the following detailed description which sets forth an illustrative embodiment and is indicative of the way in which the principles of the invention are employed.

DESCRIPTION OF PREFERRED EMBODIMENT

The nonwoven fibrous web materials formed in accordance with the invention are made by a wet paper making process that involves the general steps of forming a fluid dispersion of the requisite fibers, depositing the dispersed fibers on a fiber collecting wire in the form of a continuous sheet-like web material and hydroentangling the material without any postformation bonding treatment. The fiber dispersion incorporates up to 2% by weight, preferably about 1% by weight, of a wet strength additive and, following sheet formation, is hydroentangled to provide the desired synergistic strength and absorbency characteristics.

The fiber dispersion may be formed in a conventional manner using water as the dispersant or by employing other suitable liquid dispersing media. Preferably, aqueous dispersions are employed in accordance with known paper making techniques and, accordingly, a fiber dispersion is formed as a dilute aqueous suspension or furnish of paper making fibers. The fiber furnish is then conveyed to the web-forming screen or wire, such as a Fourdriner wire of a paper making machine, and the fibers are deposited on the wire to form a fibrous web or sheet which is subsequently hydroentangled. The sheet or web is dried in a conventional manner, but is not treated with any postformation bonding agent.

The fiber furnish is a blend of natural pulp and man-made fibers. The pulp component of the fiber furnish is the major component and can be selected from substantially any class of pulp and blends thereof. Preferably the pulp is characterized by being entirely natural cellulosic fibers and can include cotton as well as wood fibers, although softwood paper making pulp, such as spruce, hemlock, cedar and pine are typically employed. Hardwood pulp and non-wood pulp, such as hemp and sisal may also be used.

As mentioned, the nonwoven web material also contains a significant concentration of man-made fibers blended with the wood pulp. The typical man-made fiber is regenerated viscose rayon. However, as will be appreciated, the man-made fiber component is not limited to viscose rayon, but can include other cellulosic fibers. For example, cellulose acetate, polyester, nylon or polypropylene fibers also may be used. To assure complete biodegradability, the man-made fibers preferably are of a cellulosic character and non-cellulosic fibers are not employed.

Although substantially all commercial paper making machines, including rotary cylinder machines, may be used, it is desirable where very dilute fiber furnishes are employed to use an inclined fiber-collecting wire, such as that described in U.S. Pat. No. 2,045,095 issued to F. H. Osborne on Jun. 23, 1936. The fibers flowing from the headbox are retained on the wire in a random three-dimensional network or configuration with slight orientation in the machine direction while the aqueous dispersant quickly passes through the wire and is rapidly and effectively removed.

As mentioned, the fiber furnish consists of a mixture of not only natural cellulosic fibers, but also man-made fibers such as viscose or acetate rayon. The man-made fibers are preferably of a low denier of about 1–6 denier per filament (dpf). Generally, the lower denier materials are of slightly shorter length than the higher denier in view of the tendency of the lower denier fibers to entangle prior to deposition on the web forming screen. For example, 3 dpf rayon fibers can be used at lengths of about ½ inch, while it is preferred to use a 1.5 dpf fiber at a length of about 5/16 inch. As will be appreciated, longer fibers may be used where desired so long as they can be readily dispersed within the aqueous slurry of the other fibers. Although the amount of synthetic fibers used in the furnish may also vary depending upon the other components, it is generally preferred that less than 50 percent by weight be employed. Typically, the man-made content is at least 5 percent by weight with 5–30 percent by weight of rayon being used in most cases.

In addition to the man-made fibers and the conventional paper making fibers of bleached kraft, the furnish of the present invention may include two distinctively different types of natural fibers that uniquely combine to provide the desired absorbency, bulk and wet tactile properties sought after in the wet tissues of the type described. As mentioned, some strength is imparted by the kraft fibers. However, additional strength and absorbency is achieved in accordance with the present invention by including long vegetable fibers and particularly the extremely long, natural, unbeaten fibers such as manila hemp, caroa, flax, jute and Indian hemp. These very long natural fibers supplement the strength characteristics provided by the bleach kraft and, at the same time, provide a limited degree of bulk and absorbency coupled with a natural toughness and burst strength. Accordingly, the manila hemp or comparable fibers may be included in varying amounts, typically at about 5–30 percent by weight. Generally, the inclusion of such fibers is preferred, but the total amount thereof is kept at about 10 percent by weight in order to achieve a proper balance of desired properties in the end product.

Using a conventional paper making technique, the fibers are dispersed at a fiber concentration within the range of 0.5–0.005 percent by weight, and are preferably used at a fiber concentration of about 0.2–0.02 percent by weight. As will be appreciated, paper making aids, such as dispersing agents, may be incorporated into the fibrous slurry together with the aforementioned wet strength agents. These materials constitute only a minor portion of the total solid weight of the fiber furnish, typically less than one percent by weight, and facilitate uniform fiber deposition while providing the web in its wet condition with sufficient integrity so that it will be capable of retaining its integrity during the hydroentangling operation. These dispersants may include natural materials, such as guar gum, karaya gum and the like as well as man-made resin additives. The dilute aqueous fiber furnish is fed to the headbox of the paper making machine and then to the fiber-collecting wire thereof where the fibers are deposited to form a continuous web or sheet. Preferably the base web material is hydroentangled prior to the drying operation, although drying may occur immediately after web formation in a conventional manner by passing the newly formed web over a number of heated dryer drums. However, in accordance with the preferred mode of operation, the sheet material prior to drying is hydroentangled so that during the subsequent drying operation, the wet strength additive incorporated therein will tend to cure and provide the desired wet strength characteristics without significantly hampering or detracting from the high absorbency characteristics imparted to the web by the hydroentangling operation.

The wet strength agent added to the fiber furnish prior to web formation may include any one of a number of well-known materials suited for pre-formation addition to the fiber furnish. This may include various resins, such as the polyacrylamide sold by American Cyanamide under the trade designation Parez 631; however, the preferred material is a polyamide-epichlorohydrin resin. It is a cationic, water-soluble thermosetting reaction product of epichlorohydrin and a polyamide and contains secondary amine groups. A typical material of this type is sold by Hercules Chemical Company under the trademark "Kymene 557". Resins of this type are more fully described in Jones et al U.S. Pat. No. 4,218,286 issued Aug. 18, 1980, the disclosure of which is incorporated herein by reference. The water soluble, cationic thermosetting epichlorohydrin-containing resin is usually employed in amounts well less than 2 percent, that is, in the range of 0.01–1.5 percent by weight, with the preferred amount being in the range of 0.5–1.3 percent by weight.

Typically, the hydroentangling operation is carried out in the manner set forth in Viazmensky et al U.S. Pat. No. 5,009,747 issued Apr. 23, 1991. While that patent relates to a fiber web having a significantly higher man-made fiber content, preferably within the range of 40–90 percent man-made fiber, the hydroentangling operation described therein can efficaciously be employed with the web material of the present invention. Thus, as also stated in the aforementioned U.S. Pat. No. 4,755,421, the hydroentanglement treatment entangles together the fibers forming the web in such a manner as to provide total energy input of less than about 0.2 horsepower-hours per pound of web. The total energy required to treat the web can range from as low as 0.002 and typically falls within the range of 0.01–0.15 horsepower-hours per pound of web.

The basis weight for the nonwoven web material of the present invention typically is in the range of about 20–110 grams per square meter. The preferred material exhibits a basis weight of about 35–95 grams per square meter.

The expression "absorptive capacity" as used herein refers to the capacity of the material to absorb liquid (i.e., water or aqueous solution) over a period of time and is related to the total amount of liquid absorbed and held by a material at its point of saturation. The total absorptive capacity is determined by measuring the increase in the weight of the sample material resulting from the absorption of a liquid. The general procedure used to measure the absorptive capacity conforms to Federal Specification No. UU-T-595C and is expressed as a percent of the weight of liquid absorbed divided by the weight of the sample in accordance with the following equation:

$$\text{Total absorbency} = \frac{\text{Wet weight} - \text{Dry weight}}{\text{Dry weight}} \times 100.$$

Disposable wet wipes of the type described in the application will typically have an absorptive capacity of at least 500 percent, with most webs having an absorptive capacity of about 600 percent and more. These webs are readily adapted for generally family use as a wet hygienic wiping towel that will retain its strength characteristics despite packaging and prolonged storage in a wet condition. Surprisingly, these desired strength characteristics are achieved within a product that exhibits a very low density and high bulk characteristics. The resultant wipes are odor free, although preservative as well as perfumes or scents may be added. The moisturizing or wetting ingredients are mainly water that may contain other conventional ingredients such as bactericides, fungicides, bacteriostats, glycerine, lanolin, and the like.

The following examples are given for purposes of illustration only in order that the present invention may be more fully understood. These examples are not intended to in any way limit the practice of the invention. Unless otherwise specified, all parts are given by weight.

EXAMPLE I

A fiber furnish was prepared from 95% Alberta Hibrite wood pulp and 5% of 1.5 denier ⅜ inch rayon fibers. To the furnish was added 1.0% by weight of a water soluble cationic thermosetting wet strength resin (Kymene-557). The fibers were dispersed at a concentration of about 0.02% and formed into a nonwoven web material. The resultant web material was hydroentangled using the procedure outlined in U.S. Pat. No. 5,009,747 at an energy level of 0.0258 horsepower-hours per pound of web and then the web was dried. Absorption capacity measurements were taken of the web material and the result is set forth in Table 1 as Sample 1-D. Comparative absorption capacity results are set forth for Samples 1-A through 1-C where either the wet strength agent or the entanglement or both were omitted.

TABLE 1

| Sample | Wet Strength Additive | Entanglement | Absorption Capacity |
|---|---|---|---|
| 1-A | None | None | 450% |
| 1-B | Yes | None | 325% |
| 1-C | None | Yes | 463% |
| 1-D | Yes | Yes | 598% |

As can be seen from Table 1, the addition of the wet strength agent to the non-entangled nonwoven web results in an expected loss of absorption capacity. However, the combination of wet strength additive and hydroentanglement, as shown in Sample D, results in an unexpected improvement in the absorption capacity of the web material made in accordance with the invention.

EXAMPLE II

The procedure of Example I was repeated with substantially the same comparisons except that the composition of the fiber furnish was varied to show the effect of altering the pulp and rayon content. The entanglement energy level employed was 0.1115 horsepower-hours per pound of web on all samples. The properties of the resultant materials are set forth in Table 2.

As will be noted from Table 2, the combination of wet strength agent and entanglement enhances the wet properties of the material but surprisingly does not significantly adversely impact the improved absorption capacity of the resultant web materials.

EXAMPLE III

To determine the effect of varying the amount of wet strength additive, a series of nonwoven web materials were prepared in accordance with the procedure of Example I. In each instance the web materials were identically hydroentangled and the only variable was the amount of wet strength resin added to the fiber furnish. As reported in Table 3, even small amounts of resin were effective to improve the wet tensile of the nonwoven web material with the properties appearing to optimize at approximately 1% of resin addition.

TABLE 2

| Sample | (%) Fiber Comp. (Pulp/Rayon) | Wet Additive | Entangle | (%) Absorption Capacity | (g/25 mm) Tensile Dry | (g/25 mm) Tensile Wet | (g/cm/cm²) Toughness Wet | (g) Wet Tongue Tear | (microns) Thickness Wet | (microns) Thickness Dry |
|---|---|---|---|---|---|---|---|---|---|---|
| 2-A | 95/5 | No | No | 455 | 3173 | 85 | 1.6 | 176 | 180 | 263 |
| 2-B | 95/5 | No | Yes | 668 | 1330 | 242 | 22.3 | 287 | 227 | 478 |

TABLE 2-continued

| Sample | (%) Fiber Comp. (Pulp/Rayon) | Wet Additive | Entangle | (%) Absorption Capacity | (g/25 mm) Tensile Dry | (g/25 mm) Tensile Wet | (g/cm/cm²) Toughness Wet | (g) Wet Tongue Tear | (microns) Thickness Wet | (microns) Thickness Dry |
|---|---|---|---|---|---|---|---|---|---|---|
| 2-C | 95/5 | Yes | Yes | 643 | 1673 | 545 | 52 | 315 | 323 | 548 |
| 2-D | 90/10 | No | No | 465 | 3119 | 174 | 7 | 213 | 202 | 245 |
| 2-E | 90/10 | No | Yes | 648 | 1531 | 361 | 29.1 | 369 | 241 | 490 |
| 2-F | 90/10 | Yes | Yes | 684 | 1831 | 580 | 54.7 | 415 | 280 | 631 |
| 2-G | 85/15 | No | No | 478 | 3380 | 195 | 7.2 | 218 | 234 | 266 |
| 2-H | 85/15 | No | Yes | 639 | 1659 | 349 | 27.9 | 431 | 281 | 360 |
| 2-I | 85/15 | Yes | Yes | 660 | 2134 | 566 | 48.4 | 424 | 353 | 398 |
| 2-J | 80/20 | No | No | 550 | 2820 | 184 | 5.7 | 240 | 231 | 243 |
| 2-K | 80/20 | No | Yes | 648 | 1860 | 512 | 37.4 | 466 | 282 | 479 |
| 2-L | 80/20 | Yes | Yes | 703 | 2019 | 627 | 55.6 | 435 | 333 | 455 |
| 2-M | 70/30 | No | No | 546 | 2473 | 140 | 7.1 | 210 | 235 | 243 |
| 2-N | 70/30 | No | Yes | 666 | 1918 | 856 | 73 | 515 | 288 | 450 |
| 2-O | 70/30 | Yes | Yes | 647 | 2186 | 1139 | 103 | 661 | 307 | 495 |

TABLE 3

| (%) Resin Amt. | (g/25 mm) Wet tensile MD | (g/25 mm) Wet tensile CD | (g/cm/cm²) Wet Toughness MD | (g/cm/cm²) Wet Toughness CD | (%) Wet Elongation MD | (%) Wet Elongation CD |
|---|---|---|---|---|---|---|
| 0 | 120 | 120 | 10 | 10 | 23 | 27 |
| 0.3 | 270 | 225 | 10 | 15 | 8 | 20 |
| 0.7 | 400 | 338 | 17 | 23 | 9 | 21 |
| 1.0 | 510 | 425 | 21 | 30 | 9 | 21 |
| 1.3 | 550 | 380 | 17 | 24 | 7 | 19 |

EXAMPLE IV

The effect of the wet strength resin on the breakup time of the nonwoven web material when slightly agitated in water is exemplified in Table 4.

In this example, two slightly different fiber furnishes were prepared both with and without a wet strength additive. All sheets were hydroentangled in exactly the same manner at an energy level of 0.0636 horsepower-hours per pound of web and the wet strength characteristics thereof were measured.

TABLE 4

| | 85% Howe Sound Pulp 15% Rayon 1.5 d × 9 mm | | 80% Howe Sound Pulp 20% Rayon 1.5 d × 12 mm | |
|---|---|---|---|---|
| | No Kymene | 1% Kymene | No Kymene | 1% Kymene |
| Wet tensile MD | 300 | 790 | 490 | 1060 |
| (g/25 mm) CD | 310 | 1010 | 450 | 930 |
| Wet toughness MD | 29 | 50 | 42 | 94 |
| (g/cm/cm²) CD | 26 | 78 | 42 | 84 |
| Breaking time (sec) | 25 | NB | 30 | NB |

NB - Does not break up in the water

EXAMPLE V

The effect of the addition of the wet strength agent on the toughness of the nonwoven fibrous web material was determined by preparing two separate fiber furnishes. The measurements were made on the nonwoven web material after hydroentanglement as set forth in Example I.

As clearly evidenced by the figures set forth in Table 5, the addition of the wet strength agent significantly enhances the wet toughness of the nonwoven web material.

TABLE 5

| Wood Pulp/ Rayon Ratio | Wet Toughness (g/cm/cm²) No Additive MD | No Additive CD | No Additive Avg. | 1% Additive MD | 1% Additive CD | 1% Additive Avg. |
|---|---|---|---|---|---|---|
| 70/30 | 35.9 | 41.2 | 38.6 | 75.3 | 45 | 60.2 |

TABLE 5-continued

| Wood Pulp/ Rayon Ratio | Wet Toughness (g/cm/cm²) No Additive MD | No Additive CD | No Additive Avg. | 1% Additive MD | 1% Additive CD | 1% Additive Avg. |
|---|---|---|---|---|---|---|
| 95/5 | 9.8 | 11.8 | 10.8 | 49.9 | 30.7 | 40.3 |

As will be appreciated to persons skilled in the art, various modifications, adaptations, and variations of the foregoing specific disclosure can be made without departing from the teachings of the present invention.

We claim:

1. A nonwoven wipe material suited for wet household and personal care use comprising a fibrous web material comprising a mixture of pulp fibers and at least five percent by weight man-made fibers and containing less than two percent by weight of a wet strength agent, the fibers within the web material being hydroentangled at an entanglement energy level up to 0.2 horsepower-hours per pound of web, the web material exhibiting no significant reduction in absorption capacity relative to comparative material without the wet strength agent.

2. The wet wipe material of claim 1 wherein the amount of wet strength agent is present within the range of 0.1–1.5 percent by weight.

3. The wet wipe material of claim 1 wherein the wet strength agent is a water soluble reaction product of epichlorohydrin and a polyamide.

4. The wet wipe material of claim 1 wherein the amount of wet strength agent is present within the range of 0.5–1.3 percent by weight.

5. The wet wipe material of claim 1 wherein the entanglement is an amount resulting from an entanglement energy level in the range of 0.002–0.2 horsepower-hours per pound of web.

6. The wet wipe material of claim 5 wherein the entanglement energy level is in the range of 0.01–0.15 horsepower-hours per pound of web.

7. The wet wipe material of claim 1 wherein the man-made fibers comprise less than 50 percent by weight of the total fiber content.

8. The wet wipe material of claim 1 wherein the man-made fibers are regenerated cellulosic fibers and comprise 5–30 percent by weight of the total fiber content.

9. The wet wipe material of claim 1 wherein the pulp fibers in the web are selected from the group consisting of wood and nonwood natural fibers.

10. The wet wipe material of claim 1 wherein the man-made cellulosic fibers are rayon fibers.

11. The wet wipe material of claim 1 wherein the basis weight of the material is in the range of 20–110 grams per square meter and the absorptive capacity is at least 500 percent.

12. The wet wipe material of claim 1 wherein the basis weight is in the range of 50–90 grams per square meter and the absorptive capacity is at least 600 percent.

13. A biodegradable nonwoven wipe material suited for wet household and personal care use comprising a totally cellulosic fiber web material comprising 70–95 percent by weight of pulp fibers and 5–30 percent by weight of rayon fibers and containing 0.5–1.3 percent by weight of a wet strength agent, the fibers within the web material being hydroentangled at an entangling energy level in the range of 0.01–0.15 horsepower-hours per pound of web, the web material exhibiting an absorptive capacity of at least 500 percent.

14. A method of forming a nonwoven wipe material comprising the steps of forming a fiber dispersion comprising pulp fibers and at least five percent by weight of man-made fibers, adding to the dispersion less than two percent by weight of a wet strength agent, forming a web of the fibers from the dispersion, hydroentangling the fibers within the web at an entanglement energy level up to 0.2 horsepower-hours per pound of web, said energy being sufficient to impart to the web when dry an absorptive capacity of at least 500 percent.

15. The method of claim 14 wherein the amount of wet strength agent is within the range of 0.5–1.3 percent by weight.

16. The method of claim 14 wherein the wet strength agent is a water soluble reaction product of epichlorohydrin and a polyamide.

17. The method of claim 14 wherein the entanglement energy level is in the range of 0.01–0.15 horsepower-hours per pound of web.

18. The method of claim 14 wherein the man-made fibers are cellulosic fibers and comprise 5–30 percent by weight of the total fiber content.

19. The method of claim 14 wherein the pulp fibers comprise 70–95 percent by weight of the fiber content and the man-made fibers comprise 5–30 percent by weight of the fiber content, the wet strength agent is a water soluble reaction product of epichlorohydrin and a polyamide and the amount thereof is in the range of 0 5–1.3 percent by weight, and the hydroentanglement energy level is in the range of 0.01–0.15 horsepower-hours per pound of web.

* * * * *